US008020740B2

(12) United States Patent
Wang

(10) Patent No.: US 8,020,740 B2
(45) Date of Patent: Sep. 20, 2011

(54) EFFORT-SAVING STAPLER

(75) Inventor: Ching-Li Wang, Tali (TW)

(73) Assignee: Apex Mfg. Co., Ltd., Tali, Taichung Hsien (TW)

( * ) Notice: Subject to any disclaimer, the term of this patent is extended or adjusted under 35 U.S.C. 154(b) by 0 days.

(21) Appl. No.: 12/704,563

(22) Filed: Feb. 12, 2010

(65) Prior Publication Data

US 2010/0314432 A1 Dec. 16, 2010

(30) Foreign Application Priority Data

Jun. 16, 2009 (TW) ..... 98120136 A

(51) Int. Cl.
*B25C 5/02* (2006.01)

(52) U.S. Cl. ..... 227/134; 81/314; 81/342; 30/175

(58) Field of Classification Search ..... 227/120, 227/143, 181.1, 116, 134, 135, 108
See application file for complete search history.

(56) References Cited

U.S. PATENT DOCUMENTS 2,619,637 A * 12/1952 Boroughs ..... 227/120
4,984,729 A * 1/1991 Balma ..... 227/128
5,356,063 A 10/1994 Perez ..... 227/132
5,364,000 A * 11/1994 Fealey ..... 227/124
5,392,518 A * 2/1995 Means ..... 30/28
6,726,081 B1 * 4/2004 Lin ..... 227/123
2007/0221699 A1 * 9/2007 Hsu ..... 227/134

* cited by examiner

*Primary Examiner* — Anthony Stashick
*Assistant Examiner* — Kevin Castillo
(74) *Attorney, Agent, or Firm* — Alan Kamrath; Kamrath & Associates PA

(57) ABSTRACT

An effort-saving stapler includes a first activating mechanism including a first connecting section and an abutting ridge, and a second activating mechanism including a ram and an arm including a second connecting section pivotally connecting to the first connecting section at a fulcrum point "A". The stapler further includes a pushing mechanism including a third connecting section, an anvil, and an abutting ridge contacting with the abutting edge of the first activating mechanism, and with these two abutting ridges defining a contact point "B". The stapler further includes a magazine including a fourth connecting section pivotally connected to the third connecting section at a second fulcrum point "C". The fulcrum point "A", contact point "B" and fulcrum point "C" are in a straight line when bending legs of the staples for closing the staples in an effort-saving way.

9 Claims, 7 Drawing Sheets

EFFORT-SAVING STAPLER

BACKGROUND OF THE INVENTION

1. Field of the Invention

The present invention relates to an effort-saving stapler and, more particularly, to a stapler that avoids a force applied thereto, for operating the stapler, to be disintegrated in an instance when the maximum resistant force is encountered during operation.

2. Description of the Related Art

A "scissor-type" stapler can be more effort-saving than a general type stapler, for example, a stapler disclosed in U.S. Pat. No. 5,356,063. A "scissor-type" stapler particularly has two operation handles which cooperatively define a fulcrum at a position about the middle of the operation handles. In such stapler, it is obvious to a person skilled in the art to try to design a force-applying arm with a length greater than a length of a resistance arm in order to achieve an effort-saving result. Nevertheless, since the stapler is generally operated in one hand, there is a limitation in its size for easy handling, and, as such, it is rare to see a satisfactory effort-saving stapler in the market.

Additionally, it is found the most effort-requiring force when bending legs of a staple and closing it around an anvil in the stapler is in the last stage of the process of stapling. However, the current staplers suffer a problem of disintegrating the applying force rendering it impossible to effectively use 100% of work applied thereto, and having an adverse effect on an effort-saving result.

The present invention is, therefore, intended to obviate or at least alleviate the problems encountered in the prior art.

SUMMARY OF THE INVENTION

According to the present invention, an effort-saving stapler includes a first activating mechanism including a first distal end defining a gripping section that is to be gripped during the operation of the stapler, a second distal end defining a connecting section, and an abutting ridge disposed between the distal ends. The stapler also includes a second activating mechanism including a first distal end defining a gripping section that is to be gripped during the operation of the stapler, a second distal end including a ram defined on a body, and an arm branching from the body and including a connecting section pivotally connecting to the connecting section of the first activating mechanism. The second activating mechanism is pivotally connected to the first activating mechanism about a fulcrum point "A". The stapler further includes a pushing mechanism including a first distal end defining a connecting section, a second distal end including an anvil, and an abutting ridge disposed between the two distal ends and contacting with the abutting edge of the first activating mechanism for supporting the pushing mechanism on the first activating mechanism, with the two abutting ridges defining a contact point "B". The stapler further includes a magazine for receiving staples disposed between the pushing mechanism and the second activating mechanism, with the magazine including a first distal end defining a connecting section pivotally connected to the connecting section of the pushing mechanism at a second fulcrum point "C" and a second distal end defining a staple-ejecting section. Furthermore, the pushing mechanism is urged by the first activating mechanism, and, then, the pushing mechanism would urge the magazine towards the second activating mechanism during operation.

It is an object of the present invention that the fulcrum point "A" and the contact point "B" define a resistance-force lever arm "P1", the contact point "B" and the fulcrum point "C" define an applied-force lever arm "F2", and the resistance-force lever arm "P1" and the applied-force lever arm "F2" are in a straight line when bending legs of the staples for closing the staples in an effort-saving way.

Other objects, advantages, and new features of the present invention will become apparent from the following detailed description of the invention when considered in conjunction with the accompanied drawings.

DETAILED DESCRIPTION OF THE PREFERRED EMBODIMENT

Figure 1:
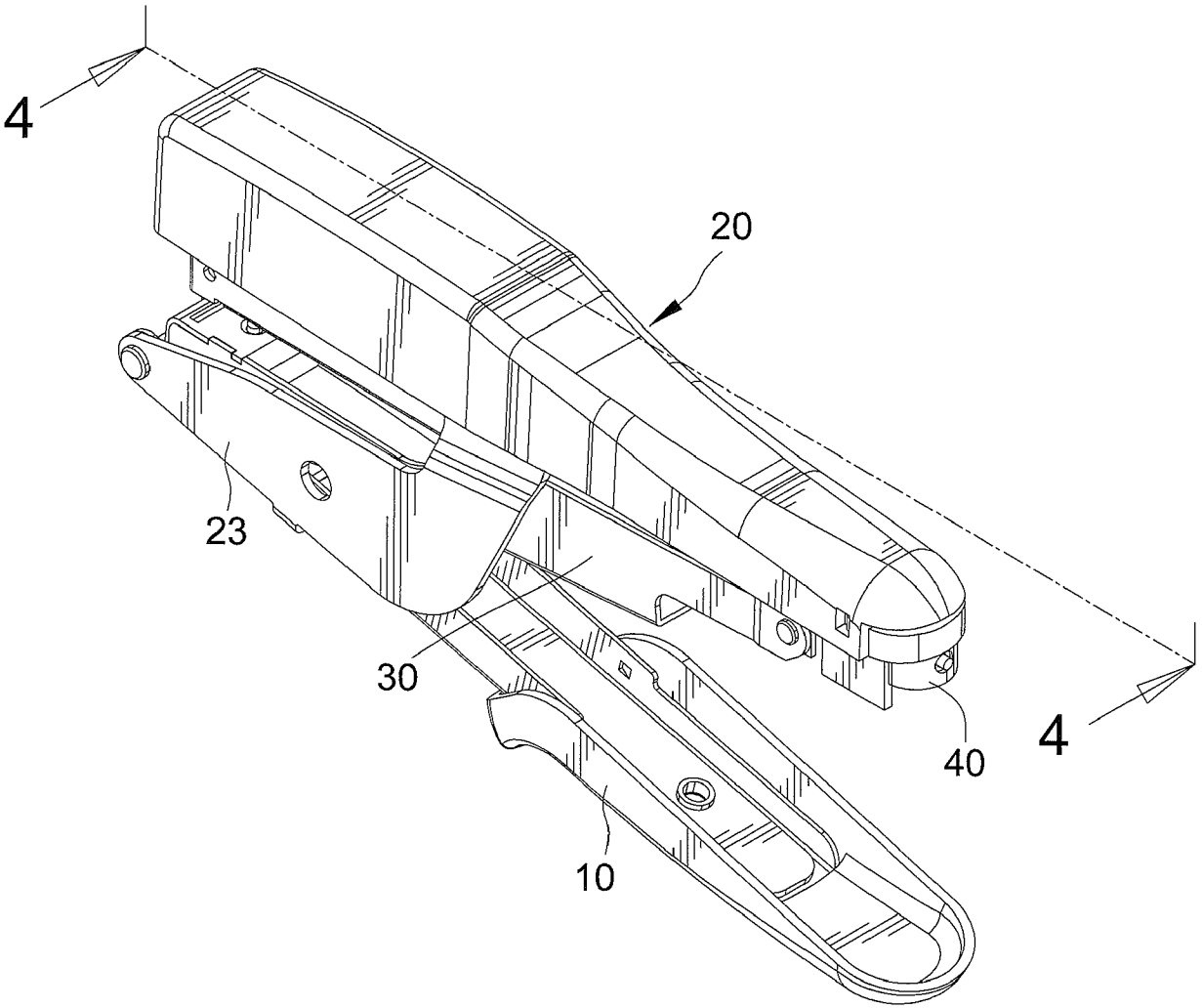
FIG. 1 is a perspective view of a stapler in accordance with the present invention.
Figure 2:
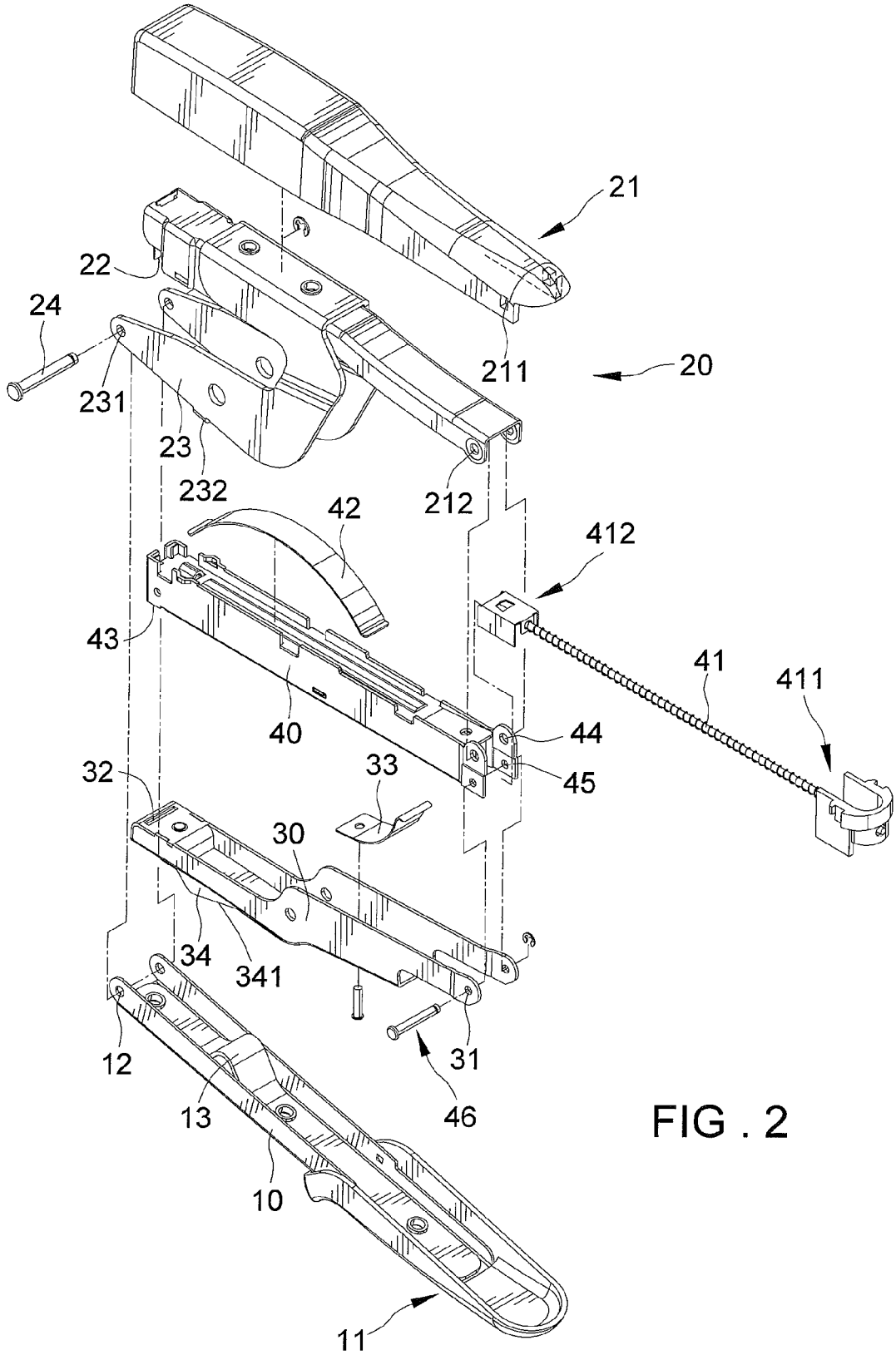
FIG. 2 is an exploded perspective view of the stapler shown in FIG. 1.
Figure 3:
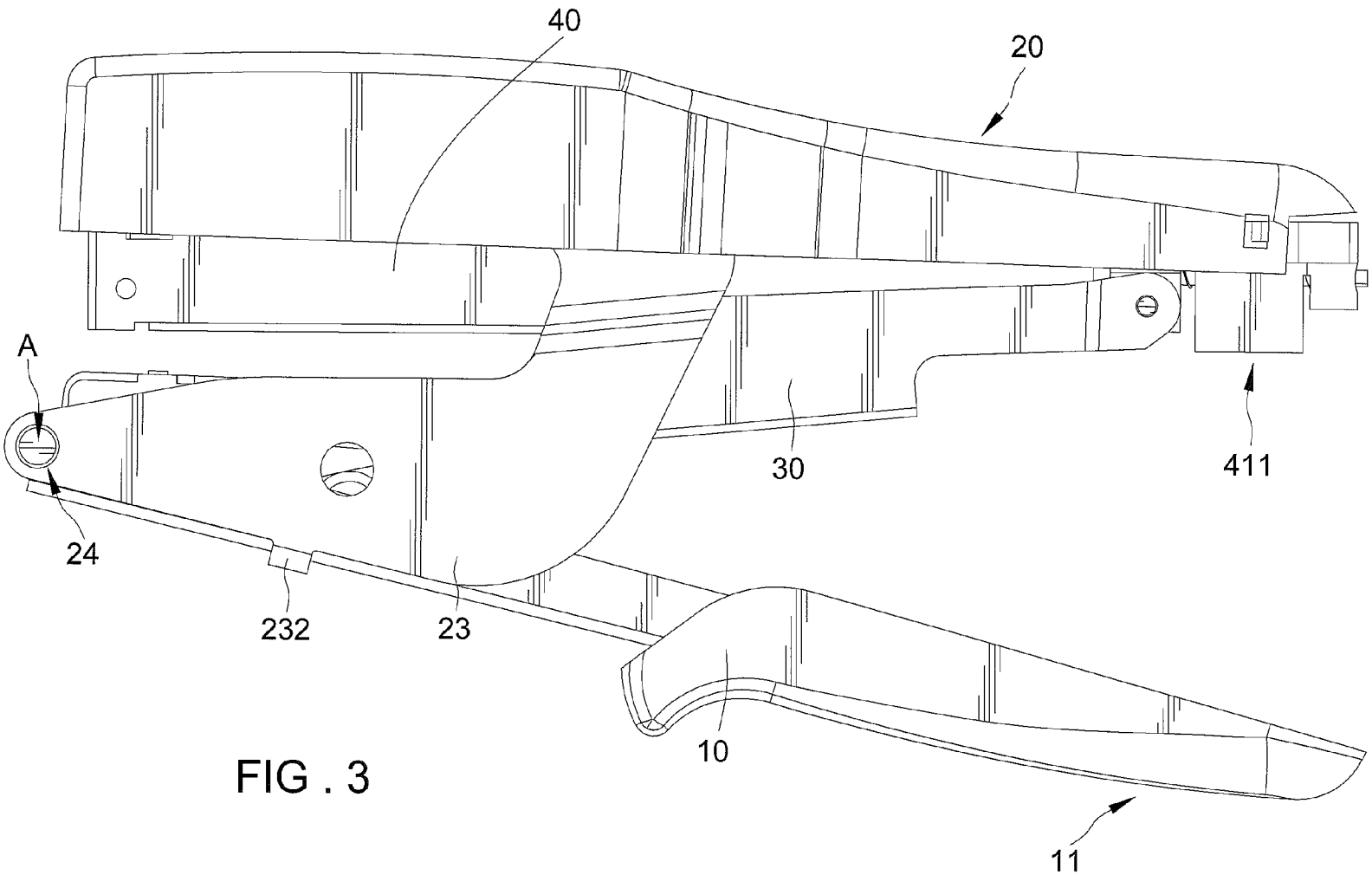
FIG. 3 is a side view of the stapler shown in FIG. 1.
Figure 4:
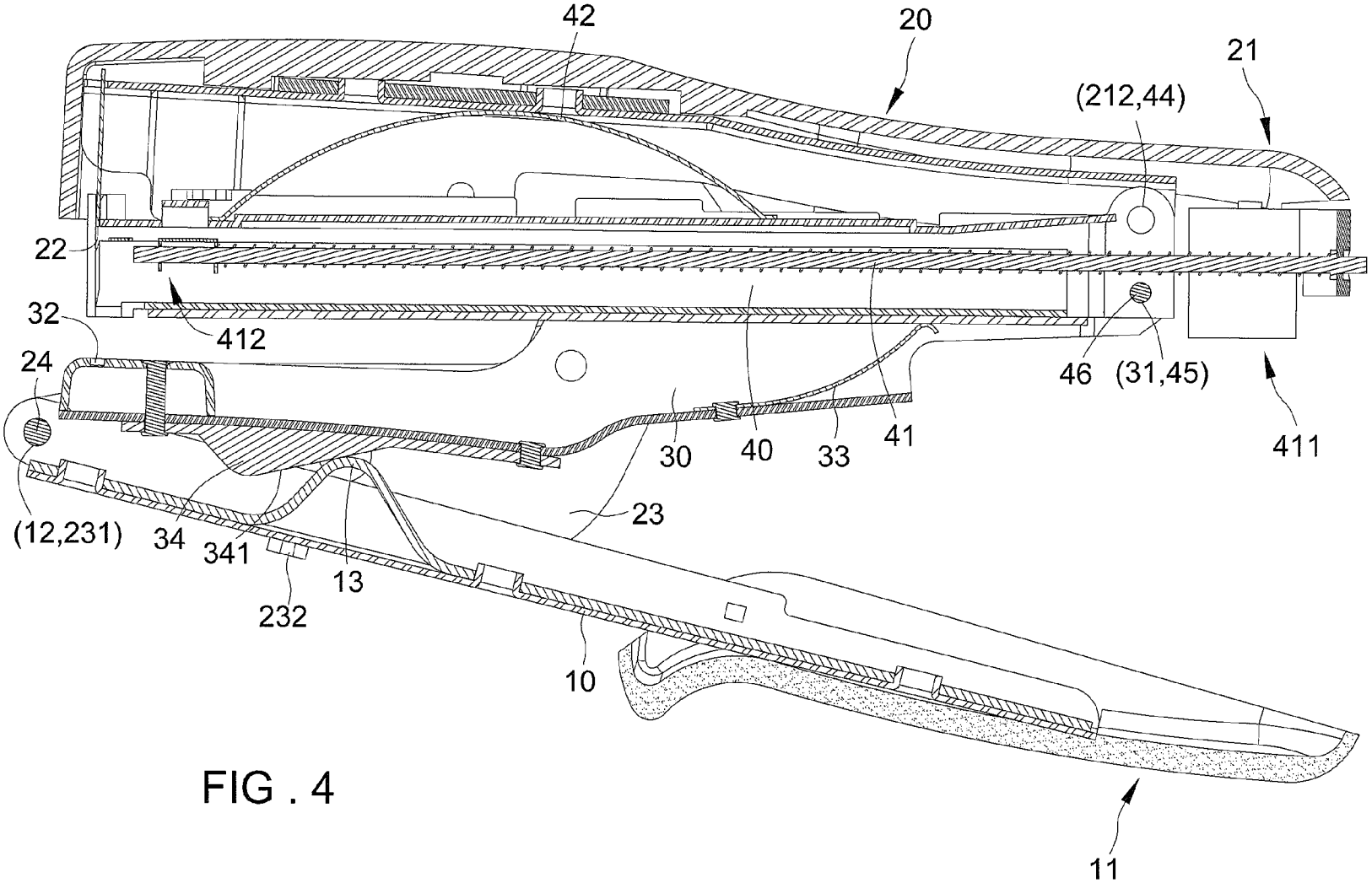
FIG. 4 is a cross-sectional view taken along line 4-4 of FIG. 1.

Referring to the drawings, a stapler in accordance with the present invention is a "scissor-type" and includes a first activating mechanism 10 including a first distal end defining a gripping section 11 that is to be gripped during the operation of the stapler and a second distal end defining a connecting section 12 pivotally connecting with a second activating mechanism 20. The second activating mechanism 20 includes a first distal end defining a gripping section 21 that is to be gripped during the operation of the stapler. The second activating mechanism 20 also includes at least one locking section 211 formed adjacent to the gripping section 21. Further, a follower 41, which is used for advancing the staples in a magazine 40, includes a first distal end including a locking end 411 engaged with the locking section 211 when the follower 41 is in a locked position. Additionally, the follower 41 includes a second distal end including a pushing end 412 that contacts with the staples in order to advance them. The second activating mechanism 20 further includes a second distal end including a ram 22 for pushing the staples in the magazine 40 out through a staple-ejecting section 43 defined thereon. The ram 22 is defined on a body and, preferably, on an end thereof. Additionally, the second activating mechanism 20 includes a connecting section 212 defined on another end of the body and an arm 23. The arm 23 branches from the body and is offset from the axis of the body and includes a connecting section 231 at a different horizontal position from that of the body. The connecting section 231 engages with the connecting section 12 of the first activating mechanism 10 such that the second activating mechanism 20 is pivotally connected to the first activating mechanism 10 about a fulcrum point "A". In the embodiment, a pivot 24 is used to connect the connecting sections 12 and 231 together. The arm 23 includes a stopping section 232 and against which the first activating mechanism 10 selectively contacts when being limited to the second activating mechanism 20. Preferably, the stopping section 232 of the aim 23 is located underneath the first activating mechanism 10. Furthermore, the aim 23 extends in a first direction downwardly from the body and then in a second direction towards the second distal end of the second activating mechanism 20. As such, the first activating mechanism 10 and the body of the second activating mechanism 20 include a space defined therebetween. The magazine 40 is disposed in the space and between the first and second activating mechanisms 10 and 20.

Figure 6:
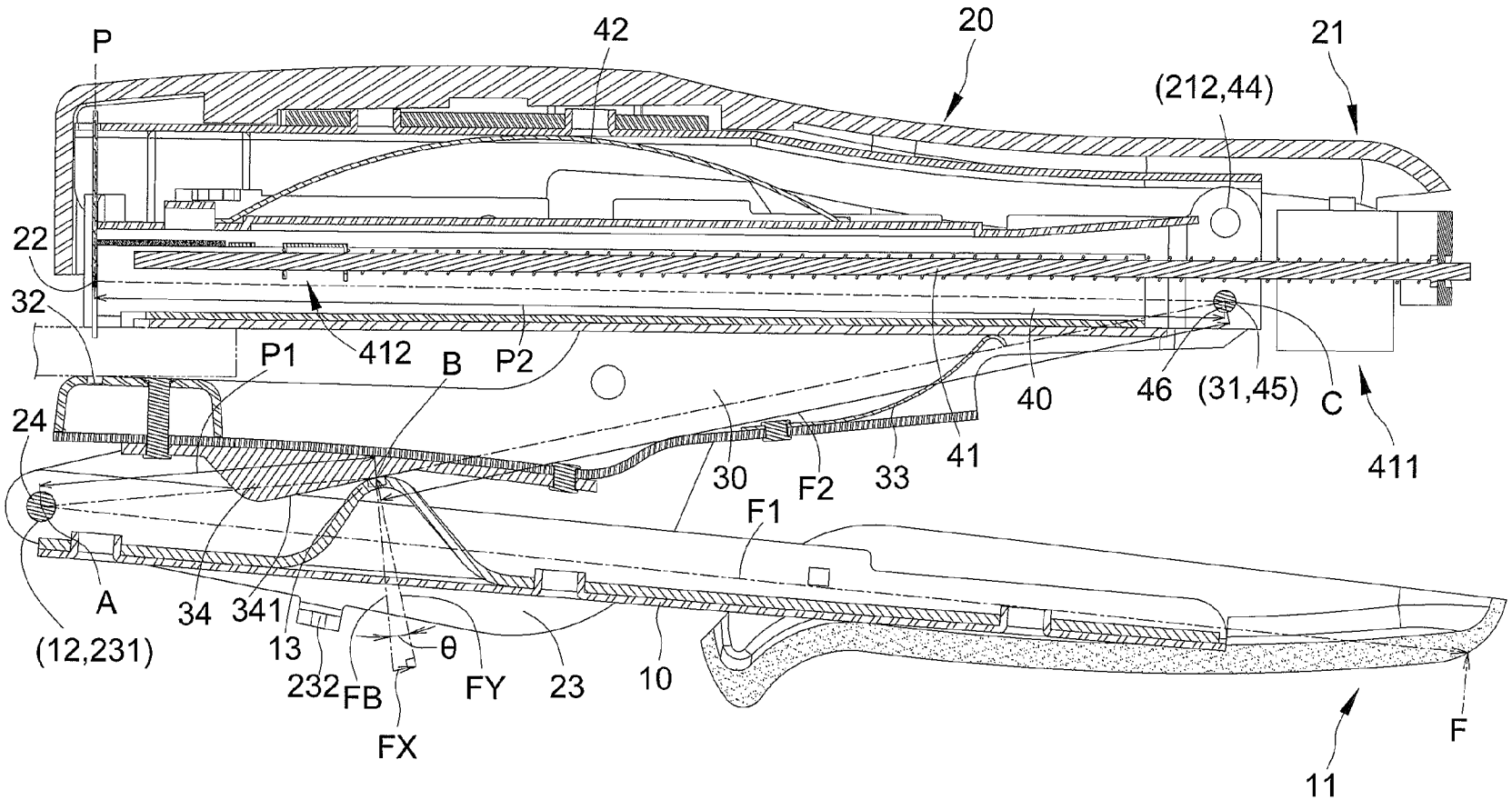
FIG. 6 is an extended cross-sectional view of FIG. 4, illustrating a staple pushed into a material to be stapled.

The stapler also includes a pushing mechanism 30 disposed in the space and between the first and second activating mechanisms 10 and 20. Specifically, the pushing mechanism 30 is disposed between the magazine 40 and the first activating mechanism 10, and the pushing mechanism 30 and the second activating mechanism 20 include the magazine 40 disposed therebetween. The pushing mechanism 30 includes a first distal end defining a connecting section 31 pivotally connecting to the magazine 40 about a fulcrum point "C" and a second distal end including an anvil 32 corresponding to the ram 22 and the staple-ejecting section 43 and with which staples pushed out of the magazine 40 by the ram 22 would contact. The pushing mechanism 30 also includes a resilient member 33 disposed thereon and which includes a portion contacting with the bottom of the magazine 40 such that the resilient member 33 would be depressed as the pushing mechanism 30 and the magazine 40 are pivoted towards each other. An abutting ridge 34 protrudes from the pushing mechanism 30 and contacts with the first activating mechanism 10 for supporting the pushing mechanism 30 on the first activating mechanism 10. The abutting ridge 34 is disposed between the first and second distal ends of the pushing mechanism 30. The resilient member 33 is in the form of a plate and has a curved cross section, but the form is not limited thereto. The abutting ridge 34 preferably includes an apex at a height from a surface of the pushing mechanism 30 from which it protrudes, with one slope extending from the apex and closer to the surface and towards the first distal end of the pushing mechanism 30 and one slope 341 extending from the apex and closer to the surface and towards the second distal end of the pushing mechanism 30. Specifically, the first activating mechanism 10 includes an abutting ridge 13 which the abutting ridge 34 of the pushing mechanism 30 engages for supporting the pushing mechanism 30 on the first activating mechanism 10. The abutting ridge 13 is disposed between the first and second distal ends of the first activating mechanism. As shown in FIG. 6, the abutting ridges 13 and 34 define a contact point "B".

The magazine 40 includes a first distal end including a first connecting portion 44 and a second connecting portion 45. The first connecting portion 44 corresponds to the connecting section 212 of the second activating mechanism 20 and is adapted to be pivotally connected therewith. The second connecting portion 45 corresponds to the connecting section 31 of the pushing mechanism 30 and is pivotally connected therewith at where the fulcrum point "C" is defined. In the embodiment, a pivot 46 is used to connect the connecting sections 31 and 45 together. The magazine 40 further includes a resilient member 42 disposed thereon and which includes a portion contacting with the bottom of the body of the second activating mechanism 20 such that the resilient member 42 would be depressed as the second activating mechanism 20 and the magazine 40 are pivoted towards each other. The resilient member 42 is in the form of a plate and has a curved cross section, but the form is not limited thereto. Additionally, the resilient member 42 includes two opposing ends contacting with the top of the magazine 40, with a portion between the two opposing ends contacting with the second activating mechanism 20 and being operably moveable away from and towards the top of the magazine 40.

Figure 5:
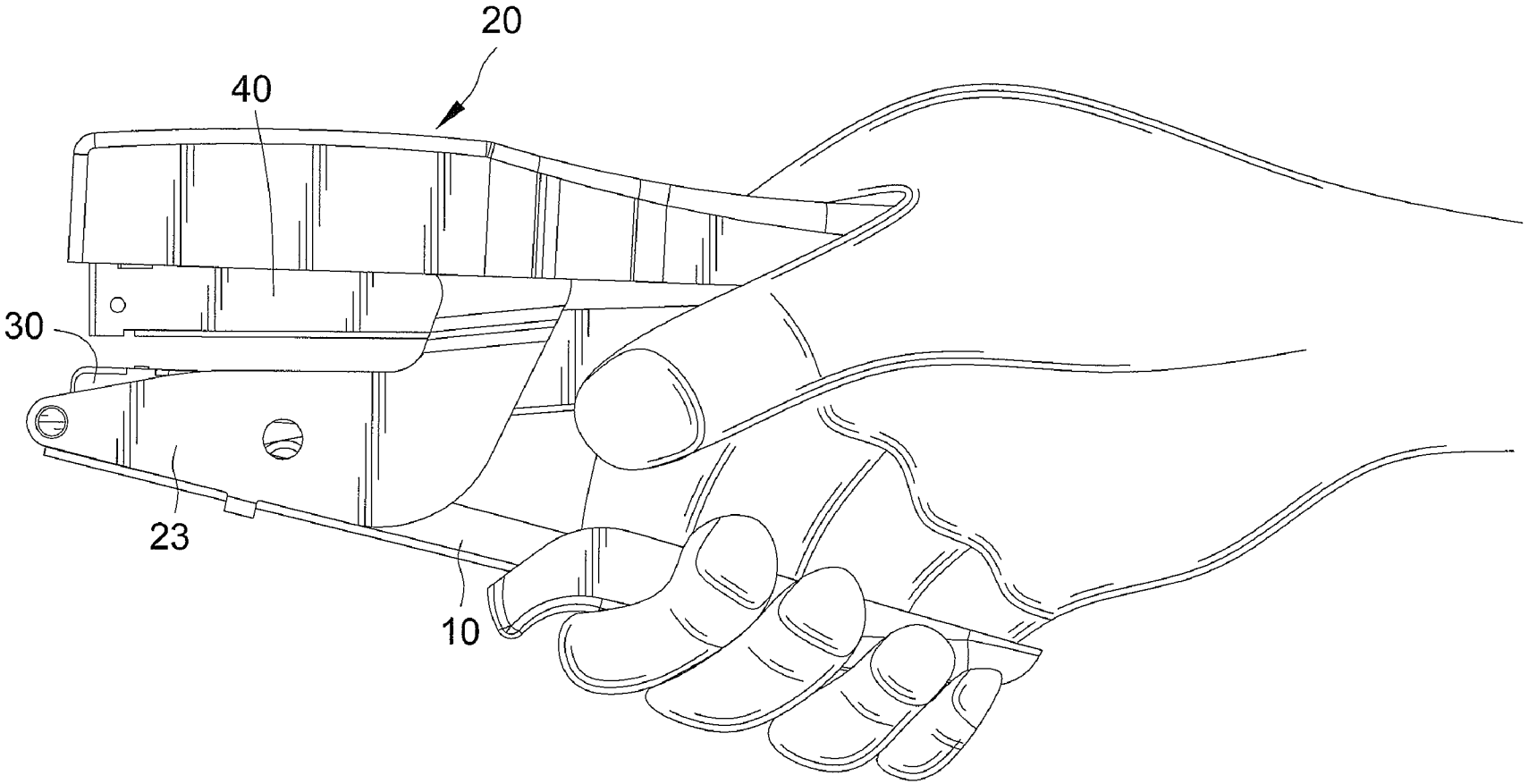
FIG. 5 is an illustrative view showing the stapler of the present invention operable with one hand.

Only one hand is used to operate the stapler, as shown in FIG. 5.

In operating the stapler, the user applies a force on the first activating mechanism 10, the pushing mechanism 30 is urged by the first activating mechanism 10, and, then, the pushing mechanism 30 would urge the magazine 40 towards the second activating mechanism 20.

Additionally, the stapler defines a first applied-force lever arm "F1" with a distance from the fulcrum point "A" to the gripping section 11 of the first activating mechanism 10 in connection with an applied force "F" on the first activating mechanism 10, a first resistance-force lever arm "P1" with a distance from the fulcrum point "A" to the contact point "B", a second applied-force lever arm "F2" with a distance from the contact point "B" to the fulcrum point "C", and a second resistance-force lever arm "P2" with a distance from the fulcrum point "C" to the ram 22. Further, when the applied force "F" applies on the first activating mechanism 10, a force "FB" will be generated and acted on the contact point "B".

In an instance that a staple is pushed out of the magazine 40 by the ram 22 and caused to impale an item to be stapled, as shown in FIG. 6, the first resistance-force lever arm "P1" and the second applied-force lever arm "F2" are not forming a straight line, and the force "FB" can be decomposed into a first component force "FX" and a second component force "FY" perpendicular to the second applied-force lever arm "F2". The force "FB" and the second component force "FY" cooperate to form an included angle "θ". Since the included angle "θ" is an acute angle, the cosine of the included angle "θ" is less than 1, and the magnitude of second component force "FY" is less than that of "FB". Therefore, the force "FB" suffers a loss and is not 100% transmitted, but rather, the force "FY" is transmitted.

Figure 7:
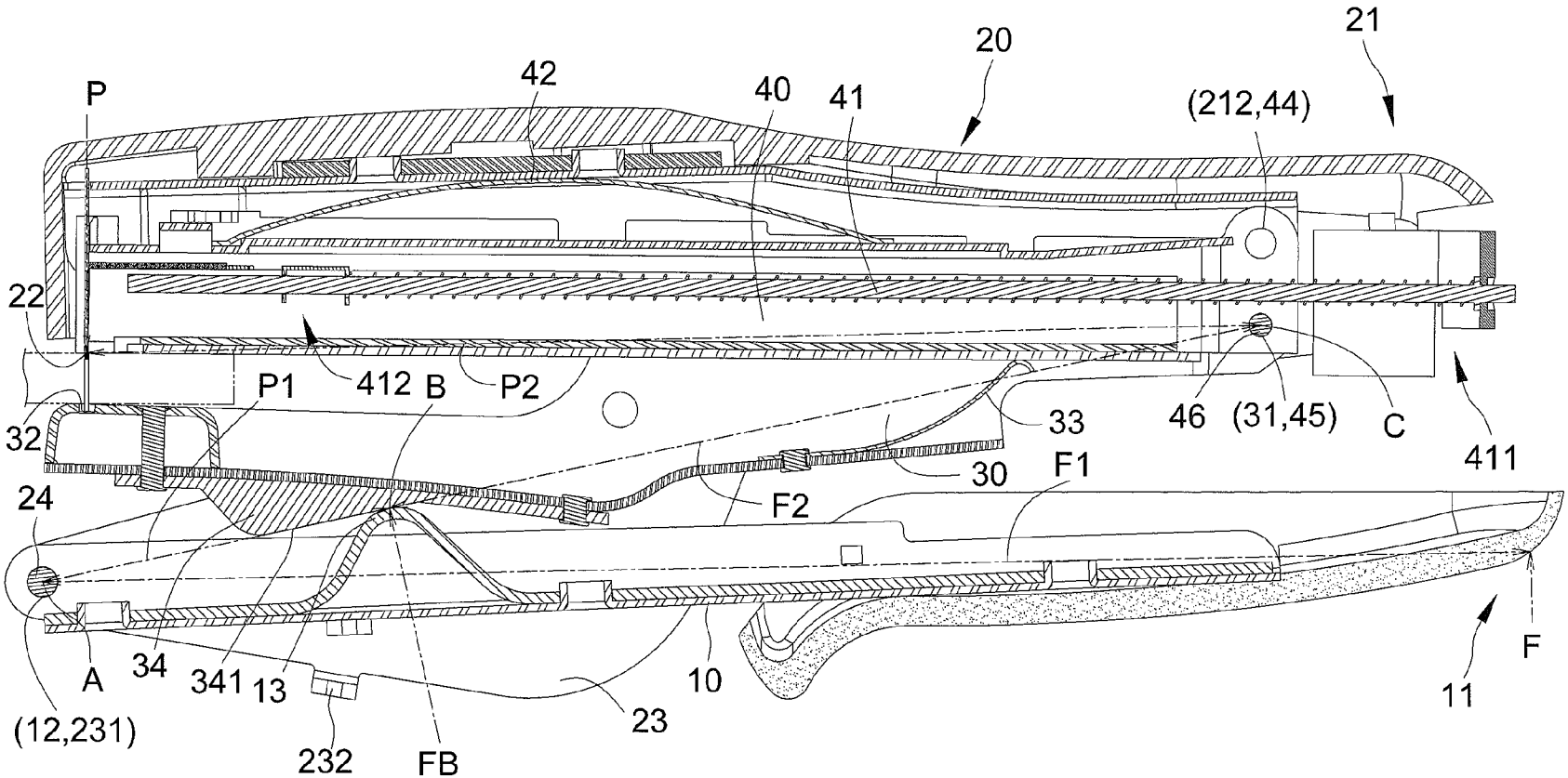
FIG. 7 is an extended cross-sectional view of FIG. 6, illustrating the staple penetrating the material and touching an anvil of the stapler of the invention.

Furthermore, if the applied force "F" is transmitted to generate a force "P" to urge the ram 22 without suffering a loss, it would be effort-saving to operate the staple. So, in a case against the loss of applied force "F" in an instance to close the staple when the maximum resistant force is encountered during operation, as shown in FIG. 7, the stapler is designed to make the first resistance-force lever arm "P1" and the second applied-force lever arm "F2" in a straight line. As a result, the force "FB" will not be disintegrated and make operation of the stapler effort-saving.

While the specific embodiments have been illustrated and described, numerous modifications come to mind without significantly departing from the spirit of invention, and the scope of invention is only limited by the scope of the accompanying claims.

What is claimed is:

1. An effort-saving stapler comprising:

a first activating mechanism including a first distal end defining a first gripping section to be gripped during operation, a second distal end defining a first connecting section, and a first abutting ridge disposed between the first and second distal ends;

a second activating mechanism including a third distal end defining a second gripping section to be gripped during operation, a fourth distal end including a ram and with the ram defined on a body, and an arm branching from the body and including a second connecting section pivotally connecting to the first connecting section, with the second activating mechanism pivotally connected to the first activating mechanism about a first fulcrum point;

a pushing mechanism including a fifth distal end defining a third connecting section, a sixth distal end including an anvil, and a second abutting ridge disposed between the fifth and sixth distal ends, with the second abutting ridge contacting with the first abutting edge for supporting the pushing mechanism on the first activating mechanism, and with the first and second abutting ridges defining a contact point; and a magazine receiving staples disposed between the pushing mechanism and second activating mechanism and including a seventh distal end defining a fourth connecting section pivotally connected to the third connecting section at a second fulcrum point and a eighth distal end defining a staple-ejecting section; and wherein the pushing mechanism is urged by the first activating mechanism, and then the pushing mechanism would urge the magazine towards the second activating mechanism during operation, wherein the first fulcrum point and contact point define a resistance-force lever arm, wherein the contact point and the second fulcrum point define an applied-force lever arm, and wherein the resistance-force lever arm and the applied-force lever arm are in a straight line when bending legs of the staples for closing the staples in an effort-saving way.

2. The effort-saving stapler as claimed in claim 1 wherein the gripping section of the first activating mechanism and the first fulcrum point define an applied-force lever arm and the second fulcrum point and the ram define a resistance-force lever arm.

3. The effort-saving stapler as claimed in claim 1 wherein the second activating mechanism includes at least one locking section formed adjacent to the second gripping section, and wherein the magazine includes a follower for advancing the staples, and with the follower including a locking end engaged with the locking section when the follower is in a locked position and a pushing end contacting with the staples in order to advance the staples.

4. The effort-saving stapler as claimed in claim 1 wherein the arm includes a stopping section against which the first activating mechanism selectively contacts when being limited to the second activating mechanism.

5. The effort-saving stapler as claimed in claim 4 wherein the stopping section of the arm is located underneath the first activating mechanism.

6. An effort-saving stapler comprising:

a first activating mechanism including a first distal end defining a first gripping section to be gripped during operation, a second distal end defining a first connecting section, and a first abutting ridge disposed between the first and second distal ends;

a second activating mechanism including a third distal end defining a second gripping section to be gripped during operation, a fourth distal end including a ram and with the ram defined on a body and an arm branching from the body and including a second connecting section pivotally connecting to the first connecting section, with the second activating mechanism pivotally connected to the first activating mechanism about a first fulcrum point;

a pushing mechanism including a fifth distal end defining a third connecting section, a sixth distal end including an anvil, and a second abutting ridge disposed between the fifth and sixth distal ends, with the second abutting ridge contacting with the first abutting edge for supporting the pushing mechanism on the first activating mechanism and with the first and second abutting ridges defining a contact point; and a magazine receiving staples disposed between the pushing mechanism and second activating mechanism and including a seventh distal end defining a fourth connecting section pivotally connected to the third connecting section at a second fulcrum point and a eighth distal end defining a staple-ejecting section; and wherein the pushing mechanism is urged by the first activating mechanism, and then the pushing mechanism would urge the magazine towards the second activating mechanism during the operation, wherein the arm extends in a first direction downwardly from the body and then in a second direction towards the fourth distal end of the second activating mechanism, and wherein the first activating mechanism and the body of the second activating mechanism include a space defined therebetween in which the pushing mechanism and the magazine are disposed.

7. The effort-saving stapler as claimed in claim 1 wherein the pushing mechanism includes a resilient member disposed thereon and contacting with the magazine such that the resilient member is depressed as the pushing mechanism and the magazine are pivoted towards each other.

8. The effort-saving stapler as claimed in claim 1 wherein the second abutting ridge includes an apex at a height from a surface of the pushing mechanism from which the second abutting ridge protrudes with one slope extending from the apex and closer to the surface and towards the fifth distal end of the pushing mechanism.

9. The effort-saving stapler as claimed in claim 1 wherein the magazine includes a resilient member disposed thereon and contacting with the body of the second activating mechanism such that the resilient member is depressed as the second activating mechanism and the magazine are pivoted towards each other.

* * * * *